US007431290B2

(12) United States Patent
Bachmeier et al.

(10) Patent No.: US 7,431,290 B2
(45) Date of Patent: Oct. 7, 2008

(54) DEVICE FOR GUIDING A PRINT CARRIER, METHOD FOR PRODUCING A PRINT CARRIER GUIDING DEVICE AND MACHINE FOR PROCESSING A PRINT CARRIER

(75) Inventors: Peter Bachmeier, Walldorf (DE); Sven Kerpe, Eggenstein-Leopoldshafen (DE); Sven Lippardt, Bensheim (DE); Peter Thoma, Mannheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 368 days.

(21) Appl. No.: 10/950,341

(22) Filed: Sep. 24, 2004

(65) Prior Publication Data

US 2005/0083387 A1 Apr. 21, 2005

Related U.S. Application Data

(60) Provisional application No. 60/508,451, filed on Oct. 2, 2003.

(30) Foreign Application Priority Data

Sep. 26, 2003 (DE) ..... 103 44 715

(51) Int. Cl.
*B65H 29/24* (2006.01)

(52) U.S. Cl. ..... 271/194; 271/97

(58) Field of Classification Search ..... 271/194, 271/195, 264, 275, 97, 211; 406/88; 198/438, 198/370.11; 414/617
See application file for complete search history.

(56) References Cited

U.S. PATENT DOCUMENTS

| | | | | |
|---|---|---|---|---|
| 3,779,545 | A | 12/1973 | Schuhmann et al. | |
| 4,218,001 | A | 8/1980 | Vits | |
| 5,549,423 | A * | 8/1996 | Lenhart | 406/86 |
| 5,687,964 | A * | 11/1997 | Stephan et al. | 271/195 |
| 5,695,302 | A * | 12/1997 | Hilbish | 406/88 |
| 5,803,448 | A | 9/1998 | Stiel et al. | |
| 5,820,306 | A * | 10/1998 | Hilbish et al. | 406/88 |
| 5,941,520 | A | 8/1999 | Stephan et al. | |
| 5,984,591 | A * | 11/1999 | Hilbish et al. | 406/88 |
| 5,988,633 | A * | 11/1999 | Henn et al. | 271/204 |
| 6,361,041 | B2 * | 3/2002 | Stephan | 271/195 |
| 6,457,409 | B2 * | 10/2002 | Fujimoto | 101/232 |
| 6,543,765 | B2 | 4/2003 | Kerpe et al. | |

FOREIGN PATENT DOCUMENTS

| | | | |
|---|---|---|---|
| DE | 28 02 610 | A1 | 7/1979 |
| DE | 40 14 830 | A1 | 1/1991 |
| DE | 44 27 448 | A1 | 2/1996 |
| DE | 195 45 799 | C1 | 1/1997 |
| DE | 197 21 907 | A1 | 3/1998 |
| DE | 199 05 095 | A1 | 8/2000 |
| DE | 100 57 570 | A1 | 6/2001 |

* cited by examiner

*Primary Examiner*—Patrick Mackey
*Assistant Examiner*—Michael C McCullough
(74) *Attorney, Agent, or Firm*—Laurence A. Greenberg; Werner H. Stemer; Ralph E. Locher

(57) ABSTRACT

A device for guiding a print carrier includes nozzles. The nozzles have tongues bounded by at least one at least approximately comb-shaped contour. A machine includes the guiding device and a method is provided for producing the guiding device.

17 Claims, 4 Drawing Sheets

DEVICE FOR GUIDING A PRINT CARRIER, METHOD FOR PRODUCING A PRINT CARRIER GUIDING DEVICE AND MACHINE FOR PROCESSING A PRINT CARRIER

CROSS-REFERENCE TO RELATED APPLICATION

This application claims the benefit under 35 U.S.C. § 119 (e), of copending U.S. Provisional Patent Application No. 60/508,451, filed Oct. 2, 2003.

BACKGROUND OF THE INVENTION

Field of the Invention

The present invention relates to a device for guiding a print carrier or printing material by nozzles, a method for producing such a device and a machine for processing a print carrier.

The typical area of use of such devices is that of sheet-fed printing presses, for example according to German Published, Non-Prosecuted Patent Application DE 40 14 830 A1, German Patent DE 195 45 799 C1 and German Published, Non-Prosecuted Patent Application DE 199 05 095 A1. The configuration and alignment of the nozzles often follows a highly complicated pattern, as is also the case, for example, according to U.S. Pat. No. 5,803,448. In order to manufacture the nozzles economically even in such cases, they can be produced from rotationally symmetrical parts, as is described in German Published, Non-Prosecuted Patent Application DE 44 27 448 A1, corresponding to U.S. Pat. No. 5,687,964. Sheet guiding devices with somewhat less complicated nozzle patterns were also known heretofore. In that regard, for example, German Published, Non-Prosecuted Patent Application DE 100 57 570 A1 corresponding to U.S. Pat. No. 6,543,765 are noted.

SUMMARY OF THE INVENTION

It is accordingly an object of the invention to provide a device for guiding a print carrier, a method for producing a print carrier guiding device and a machine for processing a print carrier, which overcome the hereinafore-mentioned disadvantages of the heretofore-known devices and methods of this general type and in which the device has particularly non-complicated but nevertheless highly effective nozzles and the method is performed without any complication of the print carrier guiding device.

With the foregoing and other objects in view there is provided, in accordance with the invention, a device for guiding a print carrier. The device comprises nozzles having tongues bounded by at least one at least approximately comb-shaped contour.

In accordance with another feature of the invention, the tongues are formed on assembled parts contoured at least approximately in a comb shape.

In accordance with an added feature of the invention, the parts are plate-shaped.

In accordance with a further feature of the invention, the parts are shell-shaped.

In accordance with an added feature of the invention, the tongues are disposed along a cutting line extending in an at least approximately meander-shaped manner.

In accordance with an additional feature of the invention, the cutting line is a laser cutting line.

In accordance with yet another feature of the invention, the tongues are disposed on both sides of the cutting line.

In accordance with yet a further feature of the invention, the nozzles are blower nozzles.

In accordance with yet an added feature of the invention, the blower nozzles have blowing directions extending at least approximately towards marginal edges of the print carrier.

In accordance with yet an additional feature of the invention, the nozzles are disposed at least approximately on a common alignment or vanishing line.

In accordance with still another feature of the invention, the common alignment or vanishing line extends at least approximately centrally with respect to the print carrier.

In accordance with still a further feature of the invention, the tongues are inclined at a shallow or acute angle relative to a guide surface.

In accordance with still an added feature of the invention, the tongues are alternatingly inclined.

In accordance with still an additional feature of the invention, the print carrier is formed in the shape of a sheet.

With the objects of the invention in view, there is also provided a method for producing a print carrier guiding device. The method comprises providing at least one workpiece having a comb contour, and forming nozzles with tongues from the at least one workpiece.

In accordance with a further mode, the method of the invention further includes providing the workpiece with an at least approximately meander-shaped incision for forming the tongues of the nozzles.

In accordance with an added mode, the method of the invention additionally includes forming the tongues of the nozzles from at least one further workpiece provided with a comb contour. The first-mentioned at least one workpiece and the at least one further workpiece are assembled so that one comb contour faces the other comb contour.

In accordance with an additional mode, the method of the invention also includes bending the tongues of the nozzles so that they are inclined.

With the objects of the invention in view, there is additionally provided a machine for processing a print carrier. The machine comprises a device having nozzles for guiding the print carrier. The nozzles have tongues bounded by at least one at least approximately comb-shaped contour.

In accordance with a concomitant feature of the invention, the machine is formed as a printing press.

Thus, the device according to the invention for guiding a print carrier includes nozzles formed with tongues which are bounded by at least one at least approximately comb-shaped contour.

This contour can be an internal or external contour. It is typical of such a comb-shaped contour that it has prongs and gaps between the prongs. The tongues of the device according to the invention therefore form the prongs of the comb-shaped contour. The tongues form areas of the nozzles which guide air flows and determine the active directions of the nozzles.

Further developments of the device according to the invention which are explained in detail below are advantageous from various points of view.

In a development which is advantageous from a fabrication or manufacturing point of view, the tongues are formed on assembled parts or pieces contoured at least approximately in a comb shape. It is possible for the parts or pieces to be plate-shaped or shell-shaped. The parts or pieces can, for example, be two or more sheet-metal plates or sheet-metal shells which together form a guide surface of the device.

Likewise advantageous from a fabrication point of view is a development wherein the tongues are disposed along a cutting line running at least approximately meander-shaped, preferably on both sides of this cutting line. The meandering shape of the cutting line can be seen from a viewing direction which is perpendicular relative to the guide surface wherein the nozzles open. Therefore, during the production thereof, the tongues are cut to shape along the meandering line, for example by a machining beam. The meandering line along which the machining beam or another cutting tool is guided instead during the production can be a zigzag line or a wavy line corresponding to a square-wave, trapezoidal or sinusoidal oscillation. The machining beam is preferably a laser beam and the cutting line is a laser cutting line.

The print carrier or printing material can be in the form of sheets or a web. However, the functional advantages resulting from the developments explained below come to fruition to a particularly great extent if the print carrier or printing material is a printing material sheet and the print carrier or printing material guiding device is accordingly a sheet guiding device. Print carrier or printing material sheets impose particularly high requirements on print carrier or printing material guiding devices which pneumatically guide the print carrier or printing material.

The nozzles can be blower nozzles, which have blowing directions directed at least approximately toward marginal edges of the print carrier or printing material. The nozzles are preferably located at least approximately on a common line of alignment or vanishing line, with the nozzles forming a row of nozzles. The blowing directions can be alternating, so that in each case two nozzles which are adjacent within the row of nozzles and follow each other are aligned at least approximately in directions opposite to one another. The blowing directions of the nozzles are preferably oriented perpendicularly to a transport direction of the print carrier or printing material. The afore-mentioned line of alignment preferably extends at least approximately centrally with respect to the print carrier or printing material, for example in the center of the sheet width.

According to a further development, the tongues are inclined at a shallow or acute angle relative to the afore-mentioned guide surface, for example so that each of the blowing directions forms an acute angle together with the guide surface. In this regard, the tongues are preferably inclined alternatingly, so that each of the tongues is inclined toward a different marginal edge of the print carrier or printing material than the tongue adjacent this tongue within the row of nozzles.

The method according to the invention for producing a print carrier or printing material guiding device having nozzles, calls for the tongues of the nozzles to be formed from at least one workpiece provided with a comb contour. This comb contour means an outline which extends at least approximately meander-shaped and bounds the tongues. The production method according to the invention is particularly efficient, because it permits the production of a comparatively large number of nozzles in comparatively few machining steps.

In a development of the production method according to the invention which is advantageous with regard to a one-piece formation of the guide surface, the tongues of the nozzles are formed from the workpiece which later forms the guide surface provided with an at least approximately meandering incision. In this regard, the workpiece is not cut through and divided up into two parts. The workpiece can, for example, be a plate formed of steel sheet or any other suitable material. With the incision or every such incision, which is introduced into the workpiece by a laser beam, for example, a plurality of nozzles is produced simultaneously. A different, dedicated incision is advantageously not required for each individual nozzle.

In another development of the method, which is advantageous with regard to a multi-piece or multi-part and, for example, two-piece or two-part formation of the guide surface, the tongues of the nozzles are formed from a further workpiece provided with a comb contour. The workpieces are then assembled so that one comb contour faces the other comb contour. For example, the two workpieces can be plates having plate edges which are contoured in a comb shape in a first step, for example by laser trimming, and, in a subsequent second step, are brought into mutual engagement in such a way that in each case the tongues or prongs of one comb contour engage in the gaps formed in the other comb contour. The plates can be bent between the first and the second steps to form shells. This intermediate step may be necessary if the guide surface is not intended to be flat but instead curved in one dimension. A further method step includes bending the tongues of the nozzles at the edge or bend so that it is inclined (relative to the guide surface). This method step, when fabrication of the guide surface is performed by a single workpiece, can be carried out following the meandering incision in this workpiece. Otherwise, in the case wherein the guide surface is assembled from a plurality of workpieces, it can be carried out following or preferably preceding the afore-mentioned second step.

The scope of the invention of the instant application also includes a machine for processing a print carrier or printing material. The machine includes a print carrier or printing material guiding device which is formed or produced in accordance with the invention. This machine is preferably a printing press but, instead, could also be a print carrier or printing material further processing machine. This machine is preferably a sheet-fed processing machine, for example a sheet-fed printing press.

Other features which are considered as characteristic for the invention are set forth in the appended claims.

The invention is illustrated and described herein as embodied in a device for guiding a print carrier, a method for producing a print carrier guiding device and a machine for processing a print carrier.

Nevertheless, the invention is not intended to be limited to the details shown, since various modifications and structural changes may be made therein without departing from the spirit of the invention and within the scope and range of equivalents of the claims.

The construction and method of operation of the invention, however, together with additional objects and advantages of the invention will be best understood from the following description of specific embodiments when that description of specific embodiments is read in connection with the accompanying drawings.

DESCRIPTION OF THE PREFERRED EMBODIMENTS

Figure 1:
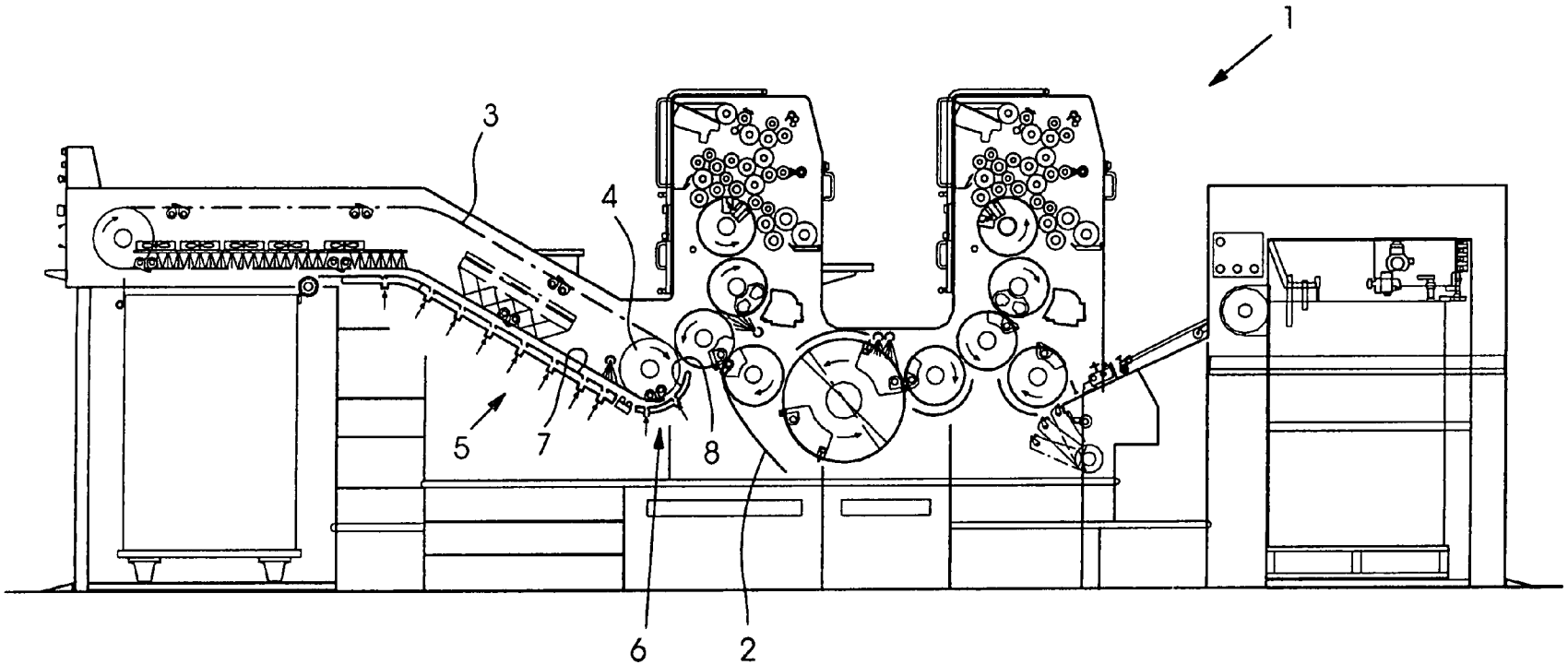
FIG. 1 is a diagrammatic, side-elevational view of a machine having a first and a second print carrier or printing material guiding device.

Referring now to the figures of the drawings in detail and first, particularly, to FIG. 1 thereof, there is seen a machine 1 for processing a print carrier or printing material sheet 2. The machine 1 is a printing press and includes a chain conveyor 3 and a drum 4 as print carrier or printing material transport devices. A first print carrier guiding device 5 and a second print carrier guiding device 6 are assigned to the two print carrier transport devices. The first print carrier guiding device 5 has a flat guide surface 7 and is disposed underneath the chain conveyor 3. The second print carrier guiding device 6 has a guide surface 8 curved concentrically with respect to the drum 4 and is disposed underneath the drum 4. The print carrier guiding devices 5 and 6 are blast or blown air boxes and serve for guiding the print carrier or printing material 2, which is dragged past them by the print carrier transport devices, through the use of blast or blown air cushions produced on the guide surfaces 7 and 8. The guide surfaces 7 and 8 respectively face towards the chain conveyor 3 and the drum 4.

Figure 2C:
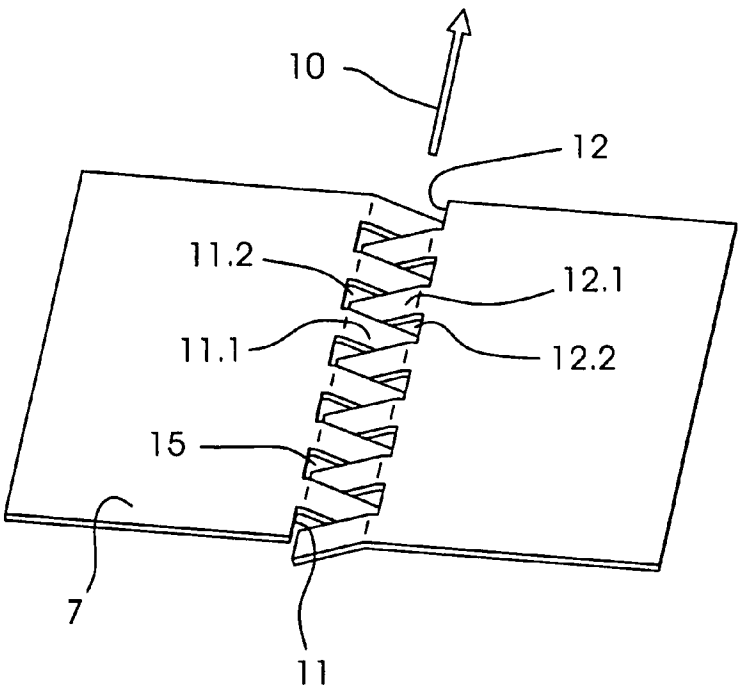
FIG. 2C is a reduced top, front and side perspective view of FIG. 2B.
Figure 2A:
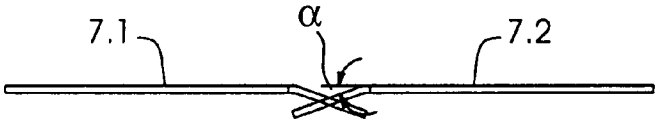
FIG. 2A is an enlarged, side-elevational view of the first print carrier guiding device.
Figure 2B:
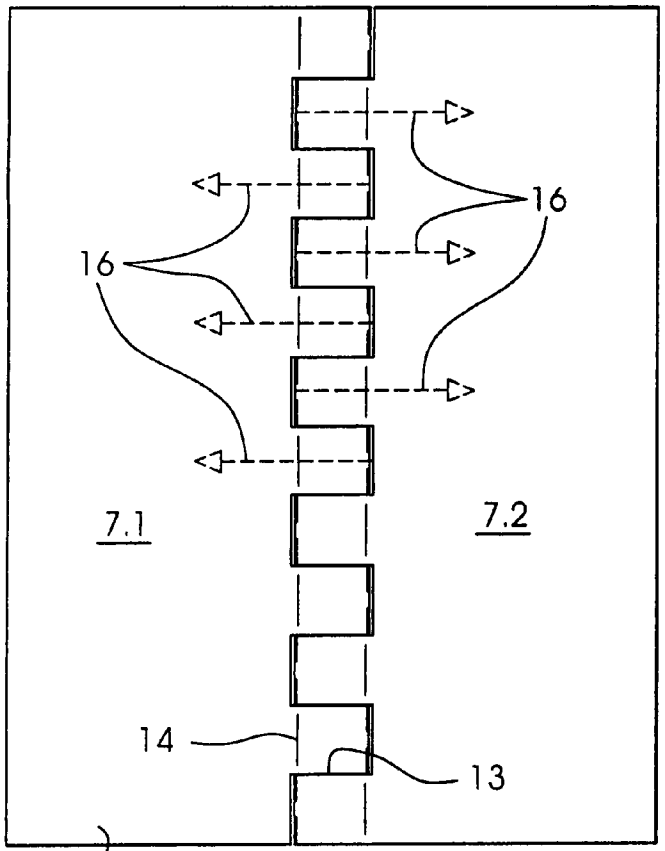
FIG. 2B is a plan view of FIG. 2A.

It is believed to be apparent from FIGS. 2A to 2C that the guide surface 7 is formed of a first part or piece 7.1 and a second part or piece 7.2. The parts or workpieces 7.1 and 7.2 are formed of sheet-metal and are plate-shaped. The guide surface 7 is equipped with a central row 9 of nozzles. The nozzle row 9 extends parallel to a transport direction 10 of the print carrier or printing material 2. The first part 7.1 has a first somewhat comb-shaped contour, i.e., a first comb contour 11, and the second part 7.2 has a second comb contour 12. The two comb contours 11 and 12 are interlaced in such a manner that tongues 11.1 of the first comb contour engage in gaps 12.2 formed in the second comb contour 12, and tongues 12.1 of the second comb contour 12 engage in gaps 11.2 formed in the first comb contour 11, when the parts or pieces 7.1 and 7.2 are assembled so as to be ready for use. The comb contours 11 and 12 are produced by dividing a plate along a meandering cutting line 13 into the two parts or pieces 7.1 and 7.2. The meandering shape of the cutting line 13 can best be seen in FIG. 2B, which is viewed perpendicularly to the guide surface 7. It is believed to be apparent from FIG. 2A, which is viewed in a direction corresponding to that of the transport direction 10, that the tongues 11.1 and 12.1 are inclined relative to the guide surface 7 at an angle $\alpha$ which is less than 45 degrees. The tongues 11.1 and 12.1 are inclined alternately to the left-hand and the right-hand side transversely with respect to the transport direction 10 and along the row 9 of nozzles and have been provided with the inclinations thereof by having the edges thereof bent over at bending lines 14, before the assembly of the two pieces 7.1 and 7.2. Each of the bending lines 14 is at the foot of the respective tongues 11.1 and 12.1. The tongues 11.1 and 12.1 and the gaps 11.2 and 12.2 together form nozzles 15. Air flows 16 of the nozzles 15 are directed towards marginal edges 17 (note FIG. 3) of the print carrier or printing material 2.

Figure 3:
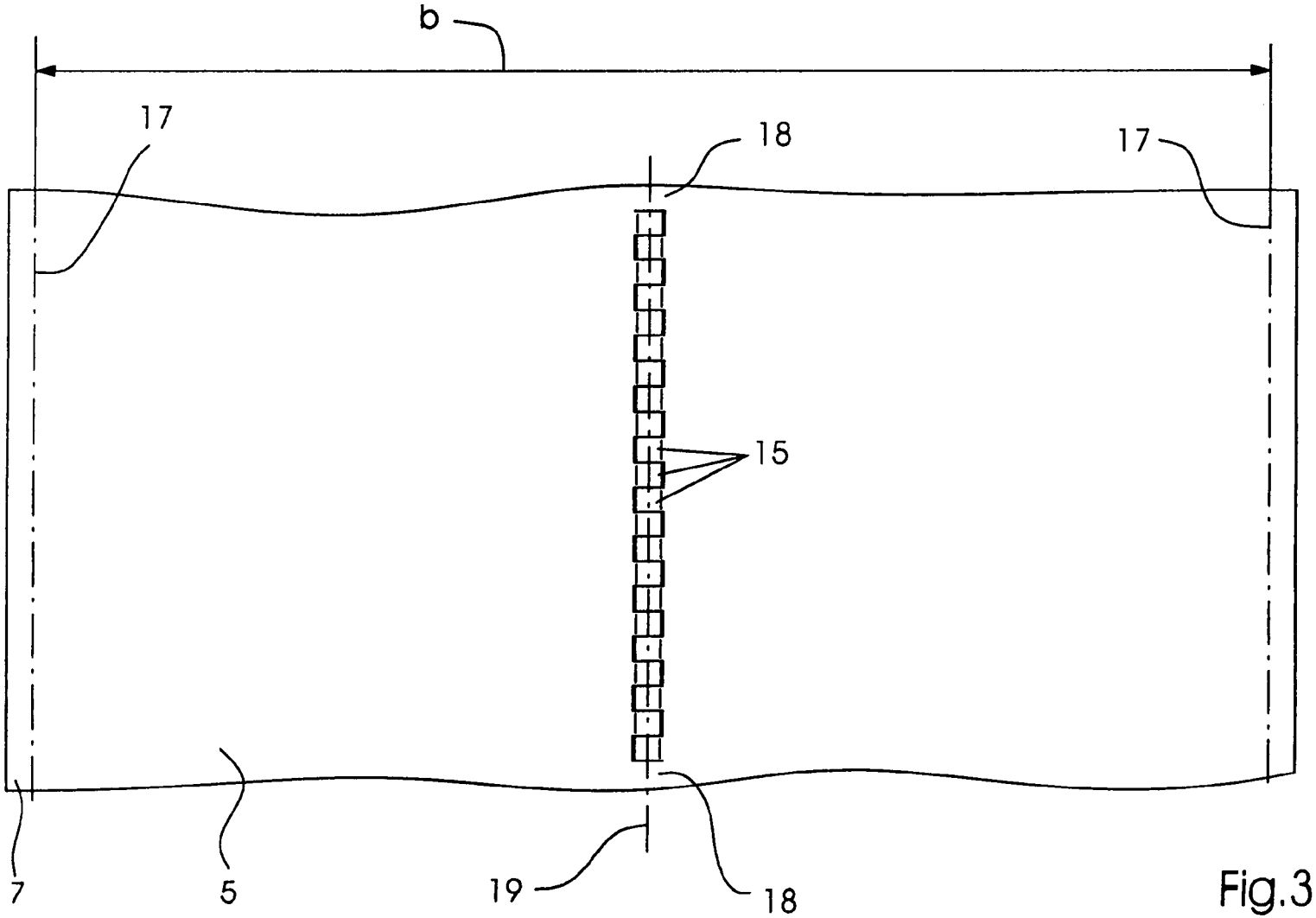
FIG. 3 is a plan view of another embodiment or modified construction of the first print carrier or printing material guiding device.

FIG. 3 illustrates a first print carrier or printing material guiding device 5 wherein the guide surface 7 is formed of a single piece or part instead of the two pieces or parts 7.1 and 7.2. During the production of such a single part or piece guide surface 7, the meandering cutting line 13 is provided only as a finite incision, so that webs 18 remain behind and the plate serving as the workpiece is not severed over the entire length thereof. Just as in the exemplary embodiment illustrated in FIGS. 2A to 2C, in the case of the embodiment or modification according to FIG. 3, after the meandering cutting, which can be performed particularly quickly and precisely by a laser beam, for example, the tongues 11.1 and 12.1 of the nozzles 15, which are disposed on a common alignment line 19, are respectively bent over and inclined. This alignment line or vanishing line 19 extends centrally with respect to a width b of the print carrier or printing material 2.

Figure 4:
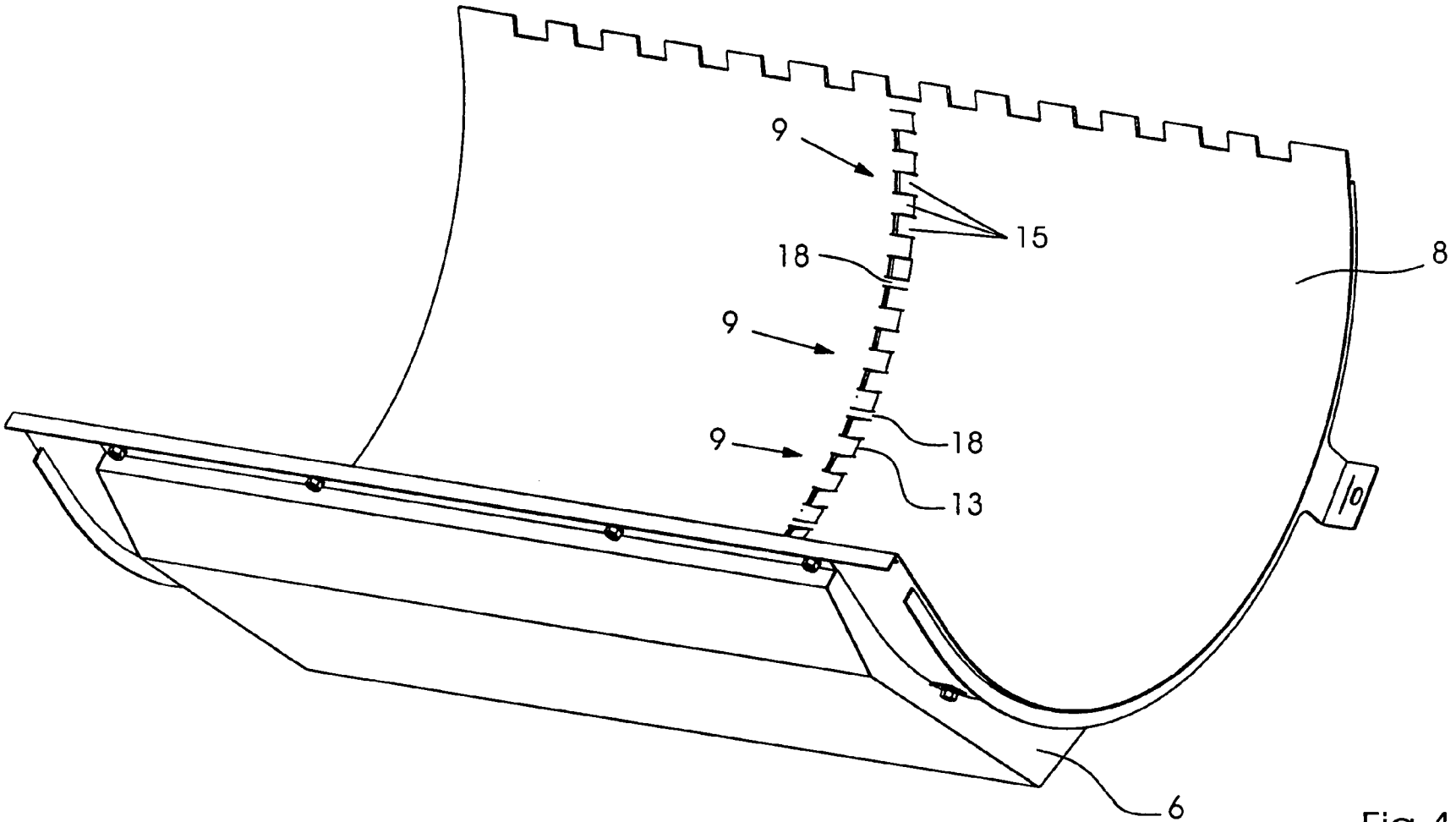
FIG. 4 is a front, side and top perspective view of the second print carrier or printing material guiding device.

The second print carrier or printing material guiding device 6 illustrated in FIG. 4 differs from the embodiment or modification of the first print carrier or printing material guiding device 5 illustrated in FIG. 3 virtually only in the fact that the guide surface 8 is formed of a shell-like (sheet-metal) piece or part instead of a plate-like piece or part. The guide surface 8 is also formed in one piece or part, just like the guide surface 7. The nozzles 15 introduced into the guide surface 8 are grouped in a plurality of rows 9 of nozzles which are aligned with one another. Each of the rows 9 of nozzles has its own meandering cutting line 13 and is separated from the row 9 of nozzles respectively adjacent thereto by a web 18 which stabilizes the guide surface 8. The rows 9 of nozzles extend in longitudinal direction centrally with respect to the width b of the print carrier or printing material (see FIG. 3).

This application claims the priority, under 35 U.S.C. § 119, of German Patent Application 103 44 715.6, filed Sep. 26, 2003; the entire disclosure of the prior application is herewith incorporated by reference.

We claim:

1. A device for guiding a print carrier, the device comprising:

a guide surface;

nozzles opening in said guide surface, said nozzles having tongues inclined at a shallow or acute angle relative to said guide surface, said tongues being opposing tongues which interlace with one another, said tongues being bounded by at least one comb-shaped contour, said comb-shaped contour being comb-shaped with respect to a viewing direction perpendicular relative to said guide surface.

2. The guiding device according to claim 1, wherein said tongues are formed on assembled parts contoured in a comb shape.

3. The guiding device according to claim 2, wherein said parts are plate-shaped.

4. The guiding device according to claim 2, wherein said parts are shell-shaped.

5. The guiding device according to claim 1, wherein said tongues are disposed along a cutting line extending in a meander-shaped manner.

6. The guiding device according to claim 5, wherein said cutting line is a laser cutting line.

7. The guiding device according to claim 5, wherein said tongues are disposed on both sides of said cutting line.

8. The guiding device according to claim 1, wherein said nozzles are blower nozzles.

9. The guiding device according to claim 8, wherein said blower nozzles have blowing directions extending towards marginal edges of the print carrier.

10. The guiding device according to claim 1, wherein said nozzles are disposed on a common alignment or vanishing line.

11. The guiding device according to claim 10, wherein said common alignment or vanishing line extends centrally with respect to the print carrier.

12. The guiding device according to claim 1, wherein said tongues are alternatingly inclined.

13. The guiding device according to claim 1, wherein the print carrier is in the shape of a sheet.

14. A method for producing a print carrier guiding device, the method which comprises:

providing at least one workpiece for defining a guide surface; and producing a comb contour in the at least one workpiece by forming nozzles with opposing tongues which interlace with one another, the tongues inclined at a shallow or acute angle relative to the guide surface from the at least one workpiece, the nozzles opening in the guide surface, and the comb contour being comb-shaped with respect to a viewing direction perpendicular relative to the guide surface.

15. The method according to claim 14, which further comprises providing the workpiece with a meander-shaped incision for forming the tongues of the nozzles.

16. The method according to claim 14, which further comprises:

providing the at least one workpiece having a comb contour as first and second workpieces having comb contours;

forming the tongues of the nozzles from the first and second workpieces-having comb contours; and assembling the first and second workpieces with the comb contours facing one another.

17. A printing press for processing a print carrier, the printing press comprising:

a guide surface for guiding the print carrier, said guide surface having nozzles therein, and said nozzles having tongues bounded by at least one comb-shaped contour formed in said guide surface, said tongues being opposing tongues which interlace with one another, said comb-shaped contour being comb-shaped with respect to a viewing direction perpendicular relative to said guide surface.

* * * * *